US005507968A

United States Patent [19]

Palaikis

[11] Patent Number: 5,507,968

[45] Date of Patent: Apr. 16, 1996

[54] CLEANSING ARTICLES WITH CONTROLLED DETERGENT RELEASE AND METHOD FOR THEIR MANUFACTURE

[75] Inventor: Liana V. Palaikis, Woodbury, Minn.

[73] Assignee: Minnesota Mining and Manufacturing Company, St. Paul, Minn.

[21] Appl. No.: 355,678

[22] Filed: Dec. 14, 1994

[51] Int. Cl.[6] ..... C11D 17/00; C11D 17/04

[52] U.S. Cl. ..... 252/90; 252/91; 252/174.23

[58] Field of Search ..... 252/90, 91, 93, 252/174.23

[56] References Cited

U.S. PATENT DOCUMENTS

| | | | |
|---|---|---|---|
| 2,621,355 | 12/1952 | Fisher, jr. | 15/209 |
| 2,733,211 | 1/1956 | Maxcy et al. | 252/91 |
| 3,103,031 | 9/1963 | Winston | 15/506 |
| 3,337,465 | 8/1967 | Lancz et al. | 252/91 |
| 3,351,416 | 11/1967 | Demrick | 401/201 |
| 3,431,689 | 3/1969 | Schnabel | 51/400 |
| 3,788,999 | 1/1974 | Abler | 252/91 |
| 3,954,642 | 5/1976 | Schwuger | 252/91 |
| 3,956,155 | 5/1976 | Schwuger | 252/91 |
| 4,011,172 | 3/1977 | Marsan et al. | 252/187 |
| 4,014,808 | 3/1977 | Herpers, Jr. et al. | 252/135 |
| 4,145,302 | 3/1979 | Doan | 252/91 |
| 4,175,051 | 11/1979 | Imamura et al. | 252/91 |
| 4,188,447 | 2/1980 | Ehlenz | 428/310 |
| 4,189,395 | 2/1980 | Bland | 252/91 |
| 4,209,417 | 6/1980 | Whyte | 252/174.11 |
| 4,269,723 | 5/1981 | Barford et al. | 252/106 |
| 4,303,543 | 12/1981 | Mansy | 252/117 |
| 4,379,080 | 4/1983 | Murphy | 252/526 |
| 4,421,526 | 12/1983 | Strickman et al. | 51/296 |
| 4,515,703 | 5/1985 | Haq | 252/92 |
| 4,540,506 | 9/1985 | Jacobson et al. | 252/174.12 |
| 4,613,446 | 9/1986 | Magyar | 252/91 |
| 4,624,890 | 11/1986 | Lloyd et al. | 428/290 |
| 4,828,721 | 5/1989 | Bollier et al. | 252/8.7 |
| 4,842,761 | 6/1989 | Rutherford | 252/90 |
| 4,935,158 | 6/1990 | Aszman et al. | 252/91 |
| 4,987,632 | 1/1991 | Rowe et al. | 15/104.93 |
| 4,991,362 | 2/1991 | Heyer et al. | 51/400 |
| 5,025,596 | 6/1991 | Heyer et al. | 51/400 |
| 5,137,646 | 8/1992 | Schmidt et al. | 252/8.8 |
| 5,156,843 | 10/1992 | Leong et al. | 424/411 |
| 5,238,587 | 8/1993 | Smith et al. | 252/8.6 |

FOREIGN PATENT DOCUMENTS

| | | | |
|---|---|---|---|
| 0068516A1 | 1/1982 | European Pat. Off. | A47K 7/03 |
| 0353013A2 | 7/1989 | European Pat. Off. | A47L 13/17 |

*Primary Examiner*—Paul Lieberman
*Assistant Examiner*—Lorna M. Douyon
*Attorney, Agent, or Firm*—Gary L. Griswold; Walter N. Kirn; Daniel R. Pastirik

[57] ABSTRACT

A cleansing article along with its method for manufacture are provided. The cleansing article comprises a porous pad which includes a controlled detergent release composition comprising: polyacrylamide (preferably having a weight average molecular weight greater than 200,000) and detergent preferably blended to provide a weight ratio of polymer solids:detergent solids between about 1:9 and about 1:100 and more preferably between about 1:12 and about 1:30. The method comprises preparing a coatable polymer/detergent blend comprising polyacrylamide, detergent and a liquid vehicle which on drying forms a controlled detergent release composition, applying said coatable blend to a porous pad, and drying said blend to provide said controlled detergent release composition. The controlled detergent release composition is substantially retained within the pad for subsequent use and thereafter slowly released when used.

32 Claims, No Drawings

CLEANSING ARTICLES WITH CONTROLLED DETERGENT RELEASE AND METHOD FOR THEIR MANUFACTURE

The present invention relates to cleansing and scouring articles comprising a porous pad which includes a controlled detergent release composition and to a method for the manufacture of such articles including the preparation of a coatable polymer/detergent blend and the application of such a blend to a porous pad.

BACKGROUND OF THE INVENTION

Scouting and cleansing articles, e.g., for home cleaning applications are well known. Commercially available articles are often sold with soap or detergent incorporated within the article. Solid soap and detergent compositions are commonly incorporated within steel wool and other common cleansing and scouring articles. Although soaps possess the desirable properties of being slow to dissolve in water and having a sustained presence within the articles over a period of extended use, soaps typically lack one or more of the properties of good foaming, good detergency and good grease cutting ability. Moreover, the processing and manufacture of these soap containing articles requires the undesirable use of heat and/or solvents in order to adequately blend the raw materials as well as to incorporate the blended soap compositions into the cleansing article.

In order to overcome these shortcomings in the use of soaps, synthetic detergents have been used in at least some commercial scouring articles primarily because of their improved grease cutting ability and superior foaming ability. Detergents, however, are readily soluble in water and this solubility has contributed to the shortened useful life for scouring articles containing such detergents. In general, cleansing or scouring articles treated with detergents tend to lose their detergent loadings after only a few short uses or even after a single extended use. In light of the foregoing, it would be desirable to provide a cleansing article with a good grease cutting detergent that will dissolve readily in water but will release slowly from the article over an extended period of time and over a number of uses.

Scouting and cleansing articles made from steel wool are also well known. Commercially available steel wool pads include the aforementioned soaps and, consequently have exhibited the above discussed problems of poor foaming, detergency and grease cutting ability. Additionally, steel wool articles tend to rust when exposed to moisture, and the steel fibers of the pad have sharp ends which can penetrate the skin on the hand of the user. Accordingly, it is also desirable to provide the aforementioned improved detergent in a form which will release in a controlled manner after exposure to moisture and which is provided on a porous pad which will not rust or exhibit other undesirable characteristics of steel wool.

Past attempts to extend the useful life of the soap or detergent within such scouting or cleansing articles have had only limited success. These attempts have varied in their approaches but have included, for example, encapsulating the soap within a pouch-like portion of the article or by blending the soap or detergent with insoluble polymers or with binders such as cellulose and derivatives thereof. These attempts have generally been less than satisfactory for several reasons. Encapsulation of the soap within the article requires a high loading of the soap, thereby increasing the cost to manufacture the article while also retaining the aforementioned shortcomings of soaps in general. The use of binders has either failed to significantly extend the useful life of the detergent or has made the detergent less available because of the nature of the binder material employed.

Accordingly, there is a long felt and unfulfilled need in the art to provide a scouring or other cleansing article which includes a controlled detergent release composition and to provide a method for the manufacture thereof. There is also a need to provide such a controlled detergent release article having a pad constructed of a material which will not oxidize after exposure to water and which can withstand a number of uses without depleting its detergent loading. It would be especially desirable to provide in such an article a slow or controlled detergent release composition which renders the detergent readily available for its intended cleansing function, providing excellent detergency and foaming over an improved useful life for the article.

BRIEF DESCRIPTION OF THE INVENTION

The present invention provides a controlled detergent release composition and a scouring or cleansing article including such a controlled detergent release composition, the article being generally useful, for example, in home cleaning applications. The cleansing article of the invention exhibits improved properties when compared with articles in the prior art, including enhanced detergency and grease cutting properties over an extended useful life.

In one aspect of the invention, the cleansing article comprises a porous pad and a controlled detergent release composition incorporated within said pad comprising polyacrylamide having detergent blended therein. The polyacrylamide provides a polymeric matrix within the composition to temporarily retain the detergent within the article and to slowly release it during use.

In describing the articles and the controlled detergent release composition of the invention, certain terms will be understood to have the specific meanings set forth herein. "Controlled detergent release composition" refers to a composition comprising polyacrylamide with detergent blended therein, which may be incorporated within a porous pad or other substrate to release its loading of detergent over a period of time when the article is exposed to water or another solvent at a release rate which is slower than the release rate for the same type of article which includes the same porous pad and the same detergent loading but with no polymer. "Cleansing article" refers to any article useful for any cleaning application which includes a porous pad, polyacrylamide and detergent according to the invention including but not limited to home, industrial, agricultural, veterinary, automotive, office or other applications. "Porous pad" refers to any substrate which has at least one opening into which the controlled detergent release composition may be inserted, incorporated or otherwise deployed within, it being understood that at least a portion of such composition may be deployed on the exterior surface of such substrate so long as it is available for controlled detergent release as the pad is being used in its intended environment (e.g., usually an aqueous environment). "Polymer/detergent blend" refers to a coatable composition comprising polyacrylamide, detergent and a liquid vehicle (e.g., water) which can be applied to a porous pad or other substrate and which on drying forms a controlled detergent release composition.

The polyacrylamide is preferably blended with detergent to provide a weight ratio of polymer solids:detergent solids between about 1:9 and about 1:100 and more preferably between about 1:12 and about 1:30. The detergent may be prepared from one or more anionic, cationic, amphoteric and nonionic surfactants and, the preferred polyacrylamide is preferably a high molecular weight polymer having a weight average molecular weight greater than 200,000. More preferably, the weight average molecular weight of the polyacrylamide is at least about 1,000,000 and most preferably between about 1,000,000 and about 15,000,000.

The invention also provides a method for the manufacture of the foregoing articles comprising preparing a coatable polymer/detergent blend comprising polyacrylamide, detergent and a liquid vehicle which on drying forms a controlled detergent release composition applying said coatable blend to a porous pad, and drying said blend to provide said controlled detergent release composition. The controlled detergent release composition is substantially retained within the pad for subsequent use and thereafter slowly released when used.

Still another aspect of the invention provides a controlled detergent release composition, comprising polyacrylamide including detergent blended therein.

As is set forth below, the articles of the invention are preferably provided as nonwoven scouring pads made of a multiplicity of thermoplastic organic fibers which are bonded together by any number of known techniques, forming an open lofty array of fibers which are coated with the controlled detergent release composition. Articles of the invention exhibit improved detergent retention as well as improved detergency and foaming, as demonstrated in the test results set forth below.

In the present invention, the incorporation of an effective amount of detergent within a water soluble, water swellable, polymer matrix consisting of a polyacrylamide polymer of a sufficiently high molecular weight will achieve the desirable effect of providing a controlled detergent release composition effective in the aforementioned porous pads. A polyacrylamide having a weight average molecular weight greater than 200,000 will adhere to the fibers of the pad to provide a matrix which swells when wet, and which will release an effective amount of detergent during a cleaning application. Surprisingly, it has been found that the controlled detergent release composition provides unexpected improved detergency and foaming when compared with a similar scouting article treated with an equivalent loading of detergent but excluding the polyacrylamide polymer.

Those skilled in the art will more fully understand the details of the present invention upon further consideration of the remainder of the disclosure including the detailed description of the preferred embodiment and the appended claims.

DETAILED DESCRIPTION OF THE PREFERRED EMBODIMENT

The controlled detergent release composition of the invention comprises a water soluble and water swellable polyacrylamide polymer with a detergent blended therein. The composition is water soluble and may be prepared as an aqueous polymer/detergent blend and thereafter coated over a porous pad or other substrate. The preparation and the application of the blend is preferably carried out at room temperature, although it is desirable to apply heat to dry the applied blend within the article.

The preferred polyacrylamide polymer is of a sufficiently high molecular weight so that the polymer will remain adhered within the porous pad during use, swelling when moistened but dissolving only gradually with each use. The polymer releases an effective amount of detergent during each use of the cleansing article.

Preferred polyacrylamides suitable for use in the invention are those which when blended with detergent provide a viscous coatable composition which will contain the detergent adherently within the porous pad and, when in use, swell and slowly dissolve to controllably release incremental useful amounts of its detergent loading. Such polyacrylamides are commercially available as free flowing solid powders that can be dispersed and dissolved in either hot or cold water. More preferably, the polyacrylamide is a homopolymer of acrylamide which is essentially nonionic and which has an average molecular weight (weight average) exceeding 200,000 and, due to present commercial availability, more preferably has a molecular weight of at least about 1,000,000 and most preferably between about 1,000,000 and about 15,000,000. After incorporation into a polymer/detergent blend, the polyacrylamide can be crosslinked in a known manner. Preferably, however, the polyacrylamide is not crosslinked because it has been found that a polyacrylamide which is not crosslinked will perform better than a crosslinked polyacrylamide after incorporation into a porous pad. Commercially available polyacrylamide polymers suitable for use in the present invention include those available under the trade designations "Cyanamer N-300 LMW" available from American Cyanamid Corporation of West Patterson, N.J.; and polyacrylamide cat. #18, 127-7 available from Aldrich Chemical Corp. of Milwaukee, Wis. It will be understood that the invention is not limited to any one of the specific foregoing polyacrylamide polymers, and those skilled in the art will appreciate that other commercial polyacrylamide polymers and polymer blends may be used in the controlled detergent release compositions described herein. It is contemplated that any and all high molecular weight (e.g. greater than 200,000) polyacrylamide/detergent blends incorporated within a scouring pad or other substrate to provide a controlled release of detergent in a cleaning application fall within the broad teachings of the present invention.

As mentioned above, the polyacrylamide polymer is blended with a detergent to provide a polymer/detergent blend which can then be applied to a substrate such as a porous pad. It is contemplated that the detergents useful in the present invention are those which will readily dissolve in water and which provide excellent sudsing, cleaning and grease cutting properties in normal home cleaning applications. These properties are obtained in the finished scouring article by blending the detergent within the water soluble polyacrylamide polymer, thereby preserving the availability of the detergent over an extended period of time. Surprisingly, the incorporation of detergent within a high molecular weight polyacrylamide polymer has been found to enhance detergency when articles of the present invention are compared with similar cleansing articles which do not include a water swellable polyacrylamide polymer. The detergent used in articles of the invention may include one or more anionic, cationic, nonionic and amphoteric surfactants as well as combinations of such surfactants. It is desired that the detergent is mild on the skin of the user, is non-toxic and remains in the liquid state at room temperature. It is preferred that in blends of one or more anionic, nonionic, cationic and/or amphoteric surfactants, a higher concentration of anionic surfactants is desired for enhanced foaming and detergency.

Anionic surfactants function as the primary surfactant in the controlled detergent release compositions of the invention, imparting detergency to the composition. Anionic surfactants are preferably added to the polymer/detergent blend at concentrations ranging between about 5% and about 60% by weight of the dry solids. Anionic surfactants suitable for use herein include sodium or ammonium salts of sulfonated alkyls, sulfonic acids, sulfated alkyl ethers, sulfated fatty esters and lauryl sulfates. Alkyl sulfates such as sodium lauryl sulfate and ammonium lauryl sulfate can be included within the detergent formulations of the invention. Exemplary of suitable commercially available sodium lauryl sulfates are those available under the trade designations "Rhodapon LS" from Rhone Poulenc of Cranbury, N.J. and "Sulfochem SLS" from Chemron Corp. of Paso Robles, Calif. Exemplary commercial ammonium lauryl sulfates include "Rhodapon L22" from Rhone Poulenc and "Sulfochem ALS" from Chemron Corp. Alkyl ether sulfates such as sodium lauryl ether sulfate are useful in the present invention and include those available under the trade designations "Rhodapex ES" from Rhone Poulenc; "Sulfochem ES-70" from Chemron Corp.; and "Witcolate ES-3" from Witco Corp. of Connecticut. Suitable sulfonates include sodium dodecylbenzene sulfonate available commercially under the trade designations "Rhodacal DDB-40" from Rhone Poulenc; "Witcolate 1240" (slurry) from Witco Corp.; and "Biosoft D-40" from Minnesota Solvents of Minneapolis, Minn.

Amphoteric surfactants are mild secondary foaming agents imparting additional detergency as well as enhancing the blend's mildness on the skin. As a secondary foaming agent, amphoteric surfactants may be present at weight percentages ranging from about 1% to about 20% of the dry solids. Exemplary of amphoteric surfactants suitable for use in the invention include cocamidopropyl betaines such as those available commercially under the trade designations: "Mirataine CB" from Rhone Poulenc of Cranbury, N.J. Another suitable amphoteric detergem is Coco/oleoamidopropyl betaine available commercially under the trade designations: "Miranol COB" from Rhone Poulenc; "Chembetaine" from Chemron Corporation of Paso Robles, Calif.; and "Emcol COB" from Witco Corporation of Connecticut.

Nonionic surfactants may be included in the polymer/detergent blends of the invention as low foaming surfactants used for viscosity building or as medium foaming surfactants used for foam boosting. Preferably, nonionic surfactants included in the invention are those which will not cause gelling or other modifications of the polymer/detergent blend which could interfere with room temperature coating of the blend on to the substrate. The nonionic surfactants may be present at weight percentages of the polymer/detergent blend between about 1% and about 5% of the dry solids. Among nonionic surfactants and foam stabilizers suitable for inclusion herein are monoethanolamides such as cocamide MEA, available commercially under the trade designation "Alkamide C212" from Rhone Poulenc; and, "Amidex ME" from Chemron Corp. Diethanolamides such as coconut diethanolamide is suitable for use herein and is commercially available under the trade designation "Standamid SD" from Henkel Corp. of Ambler, Pennsylvania. Various other ethoxylated amines and amides along with fatty alkanolamides can be included as are known to those skilled in the art.

Cationic surfactants can be included within the polymer/detergent blend, preferably at weight percentages of the dry solids between about 1% and about 20% to act as an emulsion stabilizer and/or a viscosity builder. Amine oxides are the commonly used cationic surfactants such as lauramine oxide available under the trade designation "Rhodamox L" from Rhone Poulenc and "Chemoxide LM-30" from Chemron Corporation; lauramidopropylamine oxide available as "Rhodamox LO" from Rhone Poulenc; and, stearamide oxide available as "Chemoxide ST" from Chemron Corporation.

It is contemplated that other surfactants and blends thereof can be included in the detergent in formulating the polymer/detergent blends of the present invention. The invention is not to be limited in any way by the particular detergem formulation included within the polymer/detergent blends described herein and the foregoing discussion of specific surfactants and concentration ranges therefor should be understood to be exemplary and not limiting in any way. The formulation of a detergent blend is believed to be within the expertise of those skilled in the art, and any detergent included within a polymer/detergent blend in a manner consistent with the teachings of the present disclosure is to be construed as within the scope of the invention.

As mentioned, the polymer/detergent blends of the invention incorporate therein a detergent formulated from one or more of the above described surfactants blended with a suitable polyacrylamide polymer to provide a polymer/detergent blend which may be coated on a scouring pad or other substrate. The preferred polymer/detergent blends are those which can be blended at room temperature and, when applied to the substrate and dried, provide a water swellable controlled detergent release composition which slowly releases detergent when wet. More preferred are those water swellable compositions which dissolve very slowly over time and which are capable of remaining affixed to the scouring article over a number of uses. Such compositions will remain on the fibers of the scouring article after a single cleaning application and will re-dry thereon and subsequently provide the desired properties described above during repeated use of the scouring article. The controlled detergent release composition will provide excellent grease cutting properties with little skin irritation and will generally provide enhanced detergency when compared with the detergency of a comparable scouring article coated with a comparable loading of detergent but without the polyacrylamide.

The coatable polymer/detergent blend of the invention can be prepared, for example, by blending an aqueous solution of polyacrylamide with an aqueous solution of detergent such that the polyacrylamide comprises at least about 1% by weight of the total solids (dry weight) in the blend. More preferred are those blends having between about 1% and about 15% of the solids as polyacrylamide and, most preferred are those having between about 3% and about 10% of the solids as polyacrylamide. When the solids of the polymer/detergent blend include at least about 3% polyacrylamide, the effective life of the detergent in the scouring or cleansing pad is increased by a factor of about two or more over that of similar scouring articles which include only the detergent without the polymer. At polymer levels above about 10% of the total dried solids, the higher polymer level tends to impart an undesirable slippery feel and may further complicate the processing of the blend. At the foregoing preferred ranges, the blend can easily be processed at room temperature with elevated temperatures required only for drying the blend after it has been applied to a porous pad or substrate.

It has been found that the weight ratio of detergent solids:polymer solids within the polymer/detergent blend can be an important parameter in the formulation of suitable blends for preparing cleansing articles according to the present invention. The weight ratios to formulate usable blends will include polymer solids:detergent solids ratios between about 1:9 and about 1:100 and preferably between about 1:12 and about 1:30 and more preferably between about 1:13 and about 1:23. Within the above described preferred guidelines for formulating the blend, the viscosity of the resulting blend prior to its application will typically be between about 3,000 and about 40,000 centipoise ("cps"), as determined by a Brookfield viscometer at 25° C. using a No. 4 spindle rotated at 6 to 12 rpm, depending on the coating method being employed. The viscosity of the blend is pH dependent and can be adjusted as needed by the addition of an appropriate acid or base as well as by the use of an appropriate salt as a viscosity control agent. Citric acid and sodium hydroxide, for example, are a suitable acid and base, respectively, for achieving an adjustment to the viscosity by changing the pH. Such acids and bases can be used individually or in combination with a salt such as sodium chloride to achieve and thereafter maintain a suitable coating viscosity. Other known acids, bases and salts may also be used and their selection and use is believed to be within the skill of those practicing in the field.

It is further contemplated that the substrate to be coated with the polymer/detergent blend can include any of a wide variety of articles including, without limitation, those made of materials including sponge, paper, fabric, plastic fiber, plastic ribbon, metal fiber, metal ribbon, and composite structures incorporating one or more of the foregoing materials. Exemplary of materials made of metal fibers is steel wool. Preferably, the substrate is a porous pad made of woven cloth or of nonwoven fabrics of varying density, fiber size and thickness. All such substrates are contemplated as within the scope of the invention and, the foregoing list is intended to be illustrative and not limiting in any way. Additionally, the size and the shape of the article employed can also be varied over the broad range of sizes and shapes which are convenient and/or desirable to the users or consumers of the invention. Those skilled in the art will appreciate that the criteria for establishing comfort and ease of use will vary depending on the contemplated cleaning application for the finished product. The typical size of such articles will be sufficient, in general, to fit comfortably within the hand of the user with sizes varying over reasonable ranges to accommodate different hand sizes as well as different cleaning applications. Some practical applications for the articles of the invention include kitchen scouring and cleansing wipes as well as floor scrubbing pads, for example.

The preferred substrate for the cleansing articles of the invention is a low density, lofty, open, porous, nonwoven pad which can be used in a variety of cleaning applications but, most typically, is used as a kitchen scouring pad. Such a nonwoven pad comprises a multiplicity of crimped or undulated, thermoplastic organic filaments which are bonded together either at the opposite ends of the article Or by fiber to fiber bonding with a suitable adhesive material or by thermal bonding, for example. Nonwoven pads suitable for use in the invention include those commercially available under the trade designation "Scotch-Brite" available from Minnesota Mining and Manufacturing Company of St. Paul, Minn. Included within the preferred nonwoven articles used herein are those nonwoven pads disclosed in U.S. Pat. Nos. 4,991,362 and 5,025,596, the disclosures of which are incorporated herein by reference. As these patents disclose, such pads comprise fibers having first and second ends and, the fibers within a single pad are arranged within the pad so that the first ends of the fiber are collectively bound together at one end of the pad while the second ends are collectively bound together at the opposite end of the pad.

Although the nonwoven pads to be used in the invention are, in general, of sufficient coarseness for effective use in scouting applications, the abrasiveness of the pad can be enhanced by adhering abrasive particles to the fibers of the pads in a manner which increases the scouring ability of the article in certain uses. The application of such abrasive particles directly to the scouring pad is well known in the art. Additionally, it is contemplated that abrasive particles can be included within the polymer/detergent blend of the invention and thereby incorporated within the cleansing articles by the application of the blend to the nonwoven pads.

It is contemplated that all of the foregoing nonwoven pads are within the scope of the invention as well as other substrates which are capable of accepting the coating of the polymer/detergent blend. The foregoing nonwoven articles can be used as individual pads consisting solely of the nonwoven portion coated with the controlled detergent release composition or, the pad can comprise a nonwoven portion in conjunction with a wiping article or the like such as a nonwoven which has been laminated to another article such as a sponge, for example. Those skilled in the art will understand that the invention is not intended to be limited by the type of substrate selected for supporting the controlled detergent release composition.

In the manufacture of the cleansing article, polyacrylamide powder may be dispersed and dissolved in water to make an aqueous polymer solution which may then blended with an aqueous detergent solution of one or more surfactants under moderate shear. The polyacrylamide will preferably comprise essentially all of the solids within the polymer solution and the total solids content of the polymer solution will preferably be between about 3% and about 10% by weight. The detergent solution may be prepared by dissolving surfactant in deionized water to give a solution wherein surfactant concentration is initially between about 1% and about 50% by weight prior to mixing with the polymer solution. The polymer/detergent blend preferably comprises between about 20% and about 80% of the detergent solution and between about 10% and about 60% of the polymer solution. It has been noted that the actual concentration of detergent in the polymer/detergent blend does not appear to be critical as long as the aforementioned preferred polymer solids:detergent solids weight ratio, after drying, is achieved in the final controlled detergent release composition within the cleansing article. Alternatively, the preparation of separate polymer and detergent solutions can be avoided, and the above ingredients can be blended together in a single solution so that the concentrations of the components provide a preferred polymer solids:detergent solids ratio.

Blending and application of the detergent/polymer blend is preferably carded out at room temperature. However, polymer/detergent blends can be formulated at elevated temperatures as required.

Coloring agents, pearlizing agents, perfumes, fragrance oils, preservatives, pigments and the like may be added to the blend as well as additional abrasive particles to increase the scouting ability of the finished article. These additional ingredients are well known in the art and will not be further described. As mentioned, the polymer/detergent blend will typically have a viscosity between about 3,000 and about 40,000 centipoise which can be adjusted by the addition of an appropriate acid, base or salt. Acids such as citric acid have been used with acceptable results as well as bases such as sodium hydroxide, for example. Suitable salts include sodium chloride and sodium carbonate. The viscosity of the blend will be pH sensitive and any adjustment of the viscosity is normally made by taking into account the method by which the blend is to be applied to the substrate.

The blend may be applied to the substrate by one or more of a number of known coating techniques such as roll coating, spray coating, immersion coating, injection coating and the like. The loading of the blend on the substrate will vary according to the intended use for the finished article. For household use in kitchen scouring or dishwashing pads, for example, an adequate coating is roughly between about 0.039 g/cm$^3$ and about 0.052 g/cm$^3$ which translates to between about 3.0 and about 4.0 grams (dry weight) for a conventional lofty nonwoven abrasive pad measuring approximately 5.1 cm (2 inches) by 7.6 cm (3 inches) with an approximate thickness of about 2.0 cm (0.8 inch) and having a total volume of about 77 cm$^3$. Once the blend is applied to the substrate, the article is dried in a known manner to remove solvent. Heating in a conventional forced air oven at a temperature of between about 200° F. (93° C.) and about 300° F (149° C.) for between 5 and 45 minutes is usually sufficient to evaporate the excess water and to fully dry the blend into a coating which is firmly adhered to the fibers of the nonwoven article. Drying may, of course, be accomplished by any other known means such as by infrared heating or microwave heating, for example. Those skilled in the art will also appreciate that the drying conditions can be varied significantly depending on the equipment used, the total solids concentration in the polymer/detergent blend and the like.

The cleansing articles of the present invention provide a means for the controlled release of detergent during cleaning operations, providing excellent grease cutting ability and good sudsing properties while extending the effective life of the detergent significantly. The manner in which the inventive articles are manufactured and their improved performance features are further illustrated in the following examples.

EXAMPLES

Test Procedures

Four test methods were employed in evaluating the relative performance of the scouring articles made in the following Examples. These test methods were:

1. "Squeeze Test": In this test, a scouring article is passed through a pair of air driven soft nip rolls which are 25.4 centimeters (10 inches) in diameter and rotating at about 45 to 47 rpm, applying a pressure to the article of between about 1.83 kg/cm$^2$ and 2.18 kg/cm$^2$ (between 26 and 31 psi) while a water stream is run over the rolls. The article is repeatedly passed through the rolls until detergent foam is no longer detected by visual inspection. Toward the end of the test, the pad is also squeezed by hand to remove excess water and the pad is again passed through the rolls until foam from the detergent is no longer detected. The dry weight of the article is recorded before and after the completion of the test to determine the amount of material extracted from the article. The water passing over the rolls was city water (St. Paul, Minn.) run from the tap at a temperature of about 36° to 38° C. (97 to 100° F.) at a flow rate of about 20 to 25 milliliters per second. All pads tested were run through the rolls, counting the number of passes until detergent foam was no longer observed.
2. Soap Foam Life Test: A scouring article is placed within a 3.8 liter (one gallon) glass jar filled with 1.9 liters (0.5 gallon) of tap water at a temperature of about 36° to 39° C. (97° to 102° F.). The jar is sealed with a screw cap and the jar is placed on its side on a flat bed shaker (available from Eberbach Corporation of Ann Arbor, Mich.) with the longitudinal axis of the jar parallel to the line of movement. The jar and its contents are agitated on the shaker which produces a reciprocating motion of 3.81 cm (1.5 inches) for 60 seconds at a speed of 180 cycles per minute followed by 30 seconds at 280 cycles per minute. The jar was then removed from the shaker and the level of the measurable foam was recorded as centimeters of foam per one cycle. The pad was removed from the jar and set aside while the jar is rinsed and replenished with fresh water. The same procedure is then followed until no measurable foam (e.g. less than 0.125 inch or 3.2 mm) is observed. For each of the pads tested, the total number of cycles and the cumulative centimeters of foam were recorded and the cycles per article were also normalized for the detergent loadings and reported as cycles per gram of detergent.
3. "Oil Challenge Test": A more rigorous variation of the above Soap Foam Life Test, referred to as the "Oil Challenge Test", was also performed for at least some of the sample scouring articles. The test requires the addition of a 1 milliliter aliquot of fresh cooking oil (vegetable oil was used) to the fresh water in the jar during each test cycle. This test is otherwise identical to the Soap Foam Life Test. The cumulative centimeters of foam and the total number of cycles per article were recorded and the cycles per article were also normalized for the detergent loadings and reported as cycles per gram of detergent.
4. "Soap Solubility Test" In this test, the dry weight of the pad is recorded and the pad is then placed within the cage of a cage type mixing blade (Model HS-1 available from the Jiffy Mixer Company of Tustin, California). The cage and the pad are placed in 3.8 liters (1 gallon) of tap water within a 19 liter (5 gallon) polyethylene pail with the water temperature at about 41 to 42° C (106 to 108° F). The cage is centered within temperature at about 41° to 42° C. (106° to 108° F.). The cage is centered within the water solution in the pail and the mixer is turned on so that the cage and the pad stir the water solution at 135 rpm for selected periods of 15 seconds, 30 seconds, 1 minute or 5 minutes. The pad is removed from the water solution using forceps and placed on end on a rack for one minute to ensure no further dripping from the pad. The pad is then dried to a constant weight at 115° C. (240° F.) and the weight is recorded. Detergent remaining within the pad is subsequently rinsed from the pad through a series of slow cycles in the flat bed shaker, described above, at a temperature of 38 to 42° C. (100° to 108° F.). The pad is dried to a constant weight and the weight percentage of detergent dissolved from the pad at each of the time periods is calculated and reported.

Unless otherwise specified, the water used in all of the testing was tap water supplied by the city of St. Paul, Minn. The water is of moderate hardness at about 85.6 to 102.7 milligrams per liter hardness (based on calcium carbonate, for example). During the testing, to avoid inconsistent data, all pads were thoroughly dried after coating and prior to measurement to allow the pads to equilibrate to room temperature conditions and to thoroughly dry the water soluble polymer. Thorough drying of the pads is critical because the presence of excess water in the pads will lead to premature swelling of the polymer along with at least some dissolution of the detergent, thereby adversely affecting the results of the testing.

Ingredients

Ingredients used in the formulation of the scouring articles described in the following Examples are identified by their chemical names and, when possible, by their trade designations. The trade designations shall be understood to have the following meanings.

"Sulfochem ES-70" is the trade designation for a sodium lauryl ether sulfate, an anionic surfactant, available from Chemron Corporation of Paso Robles, Calif.

"Amidex CME" is the trade designation for Cocamide MEA, a superamide foam stabilizer also available from Chemron Corporation.

"Cyanamer N-300 LMW" is the trade designation for a polyacrylamide polymer having an average molecular weight (weight average) of around 5–6 million and available from American Cyanamid Corporation.

"Cyanamer P-21" is the trade designation for a polyacrylamide polymer that is 90% nonionic with 10% anionic acrylate functionality, having an average molecular weight (weight average) of around 200,000 and available from American Cyanamid Corporation.

"Polyacrylamide cat.#18, 127-7" is the catalog designation of a polyacrylamide polymer having an average molecular weight of around 5–6 million and available from the Aldrich Corporation of Milwaukee, Wis.

"Witcolate ES-3" is the trade designation for sodium lauryl ether sulfate, available from Witco Corporation of N.J.

"Emcol COB" is a trade designation for coco/oleamidopropyl betaine available from Witco Corp.

"Rhodamox L" is a trade designation for lauramine oxide, available from Rhone Poulene of Cranbury, N.J.

"Rhodamox LO" is a trade designation for lauramidopropylamine oxide, available from Rhone Poulenc.

"Alkamide C212" is a trade designation for cocamide MEA available from Rhone Poulenc.

"Biosoft D-40" is a trade designation for sodium dodecylbenzene sulfonate available from Minnesota Solvents of Minneapolis, Minn.

"Euperlan PK-771" is a trade designation for ethylene glycol distearate available from Henkel Corporation of Ambler, Pa., and used herein as a pearlizing agent.

Unless indicated otherwise, all concentrations listed in the following Examples are given as weight percentages, and all of the nonwoven articles used to make the scouring pads in the Examples were of the type disclosed in the aforementioned U.S. Pat. Nos. 4,991,362 and 5,025,596, each pad measuring approximately 5.1 cm wide by 7.6 cm in length with a thickness of about 2 cm and an approximate volume of 77 $cm^3$. Viscosity determinations were made using a Brookfield viscometer at 25° C. using a no. 4 spindle rotating at 12 rpm. The polymer/detergent blends were roll coated onto the substrates to provide a cleansing article with a loading of the controlled detergent release composition as indicated below.

EXAMPLE 1

A scouring article is made by first preparing a polymer/detergent blend to have the following weight percentages in the dry solids of the blend: 63.96% Sodium lauryl ether (3) sulfate (Witcolate ES-3); 9.14% coco/oleamidopropyl betaine (Eracol COB); 13.70% lauramidopropylamine oxide (Rhodamox LO); 4.57 % Urea; 6.57% sodium chloride; 0.46% titanium dioxide pigment; 0.05 % preservative (commercially available under the trade designation "Actamet VI" from Gray Products of Aurora, Ontario, Canada); 0.18% citric acid; and 1.37% polyacrylamide powder (Cyanamer N-300 LMW). The surfactants are blended together first and dissolved in deionized water at room temperature to make a detergent solution. The polymer powder is then blended into the detergent solution under low shear by hand mixing or using an electric mixer operated at a mixing speed around 130 rpm until the polymer is thoroughly dissolved and the blend is homogenous. The liquid composition after the addition of the polymer will be approximately 38% solids with approximately 4.3% of the solids as polyacrylamide. The viscosity of the final liquid composition will be between 4,000 and 10,000 cps. The polyacrylamide:detergent weight ratio in the dried solids is about 1:22. The polymer detergent blend is roll coated on a nonwoven article at a wet loading of between about 8.2 and 9.0 grams per pad. The pad is oven dried to a constant weight at a temperature between about 93° and about 149° C. (200° F. and 300° F.).

EXAMPLE 2

Three scouring articles were prepared with polyacrylamide/detergent blends according to the teachings of the invention. The detergent was first prepared as an aqueous solution of 49.63% deionized water, 15.25 % sodium lauryl ether sulfate (Sulfochem ES-70), 9.31% cocamide MEA (Amidex CME) and 25.81% sodium dodecylbenzene sulfonate (an aniorfic surfactant obtained from Chemron Corporation). The total solids in the detergent solution was 36% by weight. The polymer was prepared as a solution of polyacrylamide polymer (Cyanamer N-300 LMW) dissolved in deionized water with the concentration of the polyacrylamide at 8.00% by weight with no other ingredients in the solution. The solutions of detergent and of polymer were blended under stirring at slow speed (approximating hand mixing), at room temperature, for approximately 25 minutes to prepare a polymer/detergent blend consisting of 68.25% of the detergent solution and 31.75% of the polyacrylamide solution. The final % solids of the polymer/detergent blend was approximately 27.2%, with 9.3 % of these solids being polyacrylamide. The resulting blend was stringy and viscous (approximately 35,000 cps). The blend was roll-coated at room temperature onto three nonwoven pads. The pads were dried to constant weight in a forced air oven heated to about 115.5° C (240° F.). The polyacrylamide/detergent weight ratio in the dried solids was about 1:9.75. The average dry loading of the controlled detergent release composition for the two pads that were squeeze tested was 0.054 $g/cm^3$. The loading for the third pad which was soap life tested was 0.046 $g/cm^3$. The comparative test data is set forth in Example 7.

EXAMPLE 3

Three more scouring articles were prepared following the procedures and using the ingredients set forth in Example 2 except that the polymer/detergent blend included 72.50% of the detergent solution and 27.50% of the polyacrylamide solution. The final % solids of the polymer/detergent composition was approximately 28.4 %, with 7.7 % of these solids being polyacrylamide polymer. This mixture was very stringy and viscous (approximately 28,000 cps). The polyacrylamide/detergent weight ratio in the dried solids was about 1:12. The average dry loading for the two dads which were squeeze tested was 0.059 $g/cm^3$and the loading for the third pad which was soap foam life tested was 0.048 $g/cm^3$.

EXAMPLE 4

Three scouring pads were prepared following the procedures and using the ingredients set forth in Example 2 except that the polymer/detergent blend included 79.84% of the detergent solution and 20.16% of the polyacrylamide solution. The final % solids of the polymer/detergent blend was approximately 30.3%, with 5.3 % of these solids being polyacrylamide polymer. This mixture was homogenous and viscous (approximately 26,000 cps). The polyacrylamide/detergent weight ratio in the dried solids was about 1:17.95. The average dry loading for the two pads that were squeeze tested was 0.068 g/cm$^3$. The loading for the third pad which was soap life tested was 0.061 g/cm$^3$.

EXAMPLE 5

Four scouting pads were prepared following the procedures and using the ingredients set forth in Example 2 except that the aqueous polymer solution was prepared as 6.00% polyacrylamide (Aldrich cat.#18, 127-7) and the polymer/detergent blend included 69.68% of the detergent solution and 30.32% of the polyacrylamide solution. The final % solids of the polymer/detergent blend was approximately 26.9%, with 6.8 % of these solids being polyacrylamide polymer. This mixture blended easily, resulting in a uniform mixture with a viscosity of approximately 12,000 cps. The polyacrylamide/detergent weight ratio in the dried solids was about 1:14.8. The average dry loading was 0.044 g/cm$^3$ for the two pads that were squeeze tested as well as for the pads that were soap foam life tested.

EXAMPLE 6

Three "control" samples were prepared by roll coating a detergent solution onto nonwoven pads as in the Examples 2–5. The detergent solution was identical to that used in the foregoing examples. No polyacrylamide solution was used for the controls. The average dry loading for the two control pads that were squeeze tested was 0.066 g/cm$^3$; and 0.069 g/cm$^3$ for the pad that was soap life tested.

EXAMPLE 7

Squeeze tests and Soap Foam Life tests were conducted for pads of the Examples 2–6. The data from these tests were averaged and the averages are summarized in Table 1.

TABLE 1

| | SQUEEZE TEST[1] | | | SOAP FOAM LIFE TEST[2] | | | |
|---|---|---|---|---|---|---|---|
| Pads of Example | Loading (g/cm$^3$) | Total squeezes | Squeezes per gram detergent | Loading (g/cm$^3$) | Total cycles | Total cm of foam | Cycles per gram detergent |
| 2 | 0.054 | 141 | 34 | 0.046 | 5 | 26.9 | 1.4 |
| 3 | 0.059 | 182 | 41 | 0.048 | 5 | 28.4 | 1.3 |
| 4 | 0.068 | 190 | 37 | 0.061 | 8 | 56.9 | 1.7 |
| 5 | 0.044 | 202 | 59 | 0.044 | 5 | 27.9 | 1.5 |
| 6 (control) | 0.066 | 94 | 19 | 0.069 | 3 | 29.5 | 0.6 |

[1]. The Squeeze Test data is an average for two pads per Example.
[2]. The Soap Foam Life test data of Example 5 is an average for two pads. The other data for this test was collected for one pad for each remaining example.

The squeezes per gram of detergent and the cycles per gram detergent for Examples 2–6 illustrates that the polyacrylamide significantly increases the effective life of the detergent within the scouring pads of the invention. The number of squeezes per gram of dry soap and the cycles per gram detergent are significantly increased upon incorporation of the polymer, reflecting enhanced detergency and foaming at lower levels of surfactant. Similarly, the effects of viscosity and adequate mixing to achieve a smooth and homogeneous mixture, is reflected in the better performance of the pads of Examples 4 and 5.

The following examples will describe formulations in which both polymer and detergent are well-dissolved in one another.

EXAMPLE 8

Three scouring articles were prepared with a polyacrylamide/detergent blend. The detergent was first prepared as an aqueous solution by dissolving in deionized water a solids blend of 68.95% sodium lauryl ether sulfate (Witcolate ES-3), 9.85% coco/oleamidopropyl betaine (Emcol COB), 14.77% lauramido propylamine oxide (Rhodamox LO), 4.92% tallowamine ethoxylate nonionic and 1.51% sodium chloride. The total solids in the detergent solution was 36% by weight. The polyacrylamide was a low molecular weight polymer (Cyanamer P-21 ) which was added directly to the detergent solution slowly, stirring at slow speed (approximating hand mixing) at room temperature until homogenous. The resulting polymer/detergent blend was 95.01% of the detergent solution and 4.99% polyacrylamide. The final % solids of the polymer/detergent blend (dry weight) was approximately 37.4%, with 15.5 % of these solids being polyacrylamide. This resulting mixture was homogeneous and the final viscosity was between 4,000 and 10,000 cps. The resulting polymer:detergent composition was then roll-coated at room temperature on nonwoven articles. The pads were dried to a constant weight in a forced air oven heated to about 115.5° C. (240° F.). The polymer/detergent weight ratio in the dried solids was 1:6.5. The average dry loading of the controlled detergent release composition for the three pads was 0.052 g/cm$^3$.

EXAMPLE 9

Six scouring articles were prepared following the procedures and using the ingredients set forth in Example 8 except that the polymer used was a higher molecular weight polyacrylamide (Cyanamer N300 LMW). The polyacrylamide was prepared as a solution of polyacrylamide powder dissolved in deionized water at a concentration of 8% polyacrylamide (by weight) with no other ingredients in the polymer solution. The polymer/detergent blend was 83.23% of the detergent solution and 16.77% of the polyacrylamide solution. The final percent solids of the polymer/detergent composition was approximately 31.3% with 4.3 % of the solids being the polyacrylamide polymer. The polymer/detergent weight ratio in the dried solids was 1:22.5. The average dry loading for the three pads that were squeeze tested was 0.053 g/cm$^3$. The dry loading for the pad that was soap foam life tested was 0.042 g/cm$^3$; and the average dry loading for the two pads that were oil challenge tested was 0.041 g/cm$^3$. Comparative test data are tabulated in Example 13.

EXAMPLE 10

Five scouring articles were prepared following the procedures and using the ingredients set forth in Example 8 except that the polymer used was a higher molecular weight polyacrylamide (Cyanamer N300 LMW). The polyacrylamide was prepared as a solution of polyacrylamide powder dissolved in deionized water at a concentration of 8% polyacrylamide (by weight) with no other ingredients in the polymer solution. The polymer/detergent blend was 75.37% of the detergent solution and 24.63% of the polyacrylamide solution. The final percent solids of the polymer/detergent composition was approximately 29% with 6.8% of the solids being the polyacrylamide polymer. The polymer/detergent weight ratio in the dried solids was 1:13.78. The average dry loading for the three pads that were squeeze tested was 0.052 g/cm$^3$, 0.042 g/cm$^3$ for the pad that was soap foam life tested and 0.045 g/cm$^3$ for the pad that was oil challenge tested. Test data are tabulated in Example 13.

EXAMPLE 11

Ten scouring articles were prepared following the procedures and using the ingredients set forth in Example 8 except that the polymer used was a higher molecular weight polyacrylamide (Cyanamer N300 LMW). The polyacrylamide was prepared as a solution of polyacrylamide powder dissolved in deionized water at a concentration of 8% polyacrylamide (by weight) with no other ingredients in the polymer solution. The polymer/detergent blend was 80.27% of the detergent solution and 19.73% of the polyacrylamide solution. The final percent solids of the polymer/detergent composition was approximately 30.5% with 5.2% of the solids being the polyacrylamide polymer. The polymer/detergent weight ratio in the dried solids was 1:18.3. The four pads that were squeeze tested had an average dry loading of 0.042 g/cm$^3$. The average dry loading for the three pads that were soap foam life tested was 0.040 g/cm$^3$; and 0.040 g/cm$^3$ for the remaining three pads that were oil challenge tested. Test data are tabulated in Example 13.

EXAMPLE 12

An additional seven "control" pads were made according to the procedure and the ingredients used in Example 8. However, the control pads were made only with the detergent solution of Example 8 and in the absence of any polyacrylamide. The average dry loading for the three pads that were squeeze tested was 0.063 g/cm$^3$. The average dry loading for the two pads that were soap foam life tested was 0.058 g/cm$^3$ and the average for the two oil challenge tested pads was 0.056 g/cm$^3$. These pads were used as the controls in the testing set forth in the following Example 13.

EXAMPLE 13

The pads of Examples 8–11 were comparatively tested against the control pads of Example 12 to screen the effect of the lower molecular weight polyacrylamide of Example 8 on the performance of the article and to simultaneously compare the performance of the lower molecular weight polyacrylamide with the higher molecular weight polymer of Examples 9–11. Testing of the foregoing articles consisted of squeeze testing of all the articles as well as soap foam life testing and oil challenge testing of the articles of Examples 9–12. The squeeze test data is summarized in Table 2 and, the soap foam life and oil challenge data is summarized in Table 3.

TABLE 2

| | SQUEEZE TEST[1] | | |
|---|---|---|---|
| Pad of Example | Total number of squeezes | Squeezes per gram of detergent | Detergent loading (g/cm$^3$) |
| 8 | 93 | 23 | 0.052 |
| 9 | 222 | 55 | 0.053 |
| 10 | 256 | 64 | 0.052 |
| 11 | 257 | 79.5 | 0.042 |
| 12 (control) | 181 | 37 | 0.063 |

[1]. The squeeze test data for Examples 8, 9, 10 and 12 is an average for three pads per Example. The data for the pads of Example 11 is an average of four pads.

TABLE 3

| | SOAP FOAM LIFE TEST[1] | | | | OIL CHALLENGE[2] | | | |
|---|---|---|---|---|---|---|---|---|
| Pad of Example | Total cycles | Total cm of foam | Cycles per gram detergent | Average dry loading (g/cm$^3$) | Total cycles | Total cm of foam | Cycles per gram detergent | Avg. dry loading (g/cm$^3$) |
| 8 | no data | | | | no data | | | |
| 9 | 10 | 44.2 | 3.1 | 0.042 | 6 | 27.7 | 1.9 | 0.041 |
| 10 | 12 | 49.5 | 3.8 | 0.042 | 5 | 25.1 | 1.4 | 0.045 |
| 11 | 9 | 26.3 | 2.9 | 0.040 | 5 | 18.3 | 1.6 | 0.040 |
| 12 (control) | 9 | 36.3 | 2 | 0.058 | 5 | 24.6 | 1.1 | 0.056 |

[1]. The data for the soap foam life test is an average for 3 pads from Example 11 and two pads from Example 12. The data for Examples 9 and 10 was collected using one pad from each Example.
[2]. The data for the oil challenge test is an average for 2 pads from Example 9; 3 pads from Example 11; 2 pads from Example 12; and one pad from Example 10.

The performance testing set forth in Table 3 demonstrates that the lower molecular weight polyacrylamide fails to produce the desired result in the polymer/detergent blend of extending the effective life of the detergent within the scouring pad. The tallowamine ethoxylate nonionic surfactant produced a more stable foam in the controls with foaming being significantly reduced upon the addition of the low molecular weight polyacrylamide. It is believed that the molecular weight of the polyacrylamide used in Example 8 was not high enough to slow the dissolution of the polymer in water, but was effective in tying up the detergent and thereby decreasing the overall detergency of the formulation. The use of the higher molecular weight polyacrylamide in the pads of Examples 9–12 was effective in extending the useful life of these pads, as is shown by the Squeeze Test data of Table 2. As shown in Table 3, the substitution of the higher molecular weight polymer in the polymer/detergent blend, at various polyacrylamide concentrations, enhances foaming and improves the detergency of the blend, allowing a lower loading of the blend on the scouring article than would otherwise be required in the absence of the polymer.

EXAMPLE 14

An aqueous detergent blend was first formulated by blending the ingredients listed below:

| | |
|---|---|
| Sodium lauryl ether sulfate (Witcolate ES-3) | 68.95% |
| Coco/oleamidopropyl betaine (Emcol COB) | 9.85% |
| Lauramidopropylamine Oxide (Rhodamox LO) | 14.77% |
| Sodium Sulfate | 4.92% |
| Titanium Dioxide | 0.29% |
| Citric Acid | 1.22% |

The detergent solution was 35% solids. An aqueous polyacrylamide solution was prepared at 6% polyacrylamide (Cyanamer N-300 LMW) in deionized water. The resulting polyacrylamide solution was thoroughly blended into the detergent by blending 20.62% of the polyacrylamide solution and 79.38% detergent solution until the polyacrylamide was dissolved and the blend was homogenous. The viscosity of the liquid polyacrylamide/detergent blend was approximately 4,300 cps. Incorporation of the polymer solution into the detergent solution gave a composition that was 29% solids with 4.26 % of those solids as polyacrylamide. The composition was then roll coated onto ten nonwoven articles and oven dried at a temperature of about 115.5° C. (240° F.) to a constant weight. The average dry loading of the controlled detergent release composition on the pads was 0.042 g/cm$^3$ for two of the pads that were subsequently squeeze tested. Eight of the pads were used in the soap life and the oil challenge testing having an average loading of 0.045 g/cm$^3$. Comparative testing is set forth in Example 16. The polymer/detergent weight ratio in the finished dried product was 1:22.

EXAMPLE 15

Seven control samples were made according to Example 14 using the same detergent blend (without added polyacrylamide). The average dry loading for the controls was 0.065 g/cm$^3$ for the three pads which were subsequently squeeze tested and 0.055 g/cm$^3$ for the four pads used in the soap foam life and oil challenge testing of Example 16.

EXAMPLE 16

Comparative testing of the samples of Examples 14 and 15 was conducted and is summarized in Tables 4 and 5. In addition to the samples of Examples 14 and 15, additional commercially available scouting pads were included in the testing. "SOS" is a commercially available steel wool scouring pad manufactured by Clorox Corporation of Oakland, California "Never Rust" is trade designation for a commercially available scouring pad manufactured and sold by the Minnesota Mining and Manufacturing Company of St. Paul, Minn. as part of its "Scotch Brite" line of products. The soap loading for both the "Never Rust" and for the "SOS" pads was determined by initially weighing the pads and comparing the initial weights to a final weight taken after the detergent or soap was completely rinsed from the pad. The loading for the two "Never Rust" pads was between 0.040 g/cm$^3$ and 0.052 g/cm$^3$; and for the "SOS" pads was between about 0.058 and 0.084 g/cm$^3$ assuming equivalent pad volume of 77cm$^3$.

TABLE 4

| SQUEEZE TEST[1] | | | |
|---|---|---|---|
| PAD | Total number of squeezes | Squeezes per gram detergent (or soap) | Average dry loading (g/cm$^3$) |
| "SOS" | 133 | 24 | 0.072 |
| Example 14 | 257 | 79 | 0.042 |
| Example 15 | 206 | 41 | 0.065 |
| "Never Rust" | 84 | 27 | 0.040 |

[1]. The data for Example 14 is an average for two pads; three pads for Example 15; twelve pads for the "Never Rust" pads; and ten "SOS" pads.

TABLE 5

| | SOAP FOAM LIFE TEST | | | OIL CHALLENGE | | |
|---|---|---|---|---|---|---|
| PAD | Total number of cycles | Cycles per gram detergent | Total cm foam | Total number of cycles | Cycles per gram detergent | Total cm foam |
| "SOS" | 1 | 0.2 | 6.35 | 1 | 0.2 | 6.35 |
| Example 14[1] | 12 | 3.4 | 43.4 | 7 | 2.0 | 23.1 |
| Example 15[2] | 5 | 1.2 | 37.1 | 6 | 1.4 | 28.2 |
| "Never Rust" | 6 | 1.5 | 21.6 | 3 | 0.76 | 16.5 |

[1]. Eight pads of Example 14 were used, four for the soap foam life test and four for the oil challenge (avg. dry loading 0.045 g/cm$^3$). The reported results are an average.
[2]. Four pads of Example 15 were used, one in the soap foam life test and three in the oil challenge (avg. dry loading 0.055 g/cm$^3$). The reported results are an average.

The data in Tables 4 and 5 illustrate the improved performance of pads made according to the teachings of the present invention. Of the pads tested in Example 16, the pad of Example 14 clearly showed the best performance, giving test values (when corrected for the loading of detergent in the various articles being tested), nearly twice those of the control samples or the commercial pads. The results indicate the superior detergency and foaming of the polymer/detergent blends of the invention.

EXAMPLE 17

Soap solubility testing was conducted for 12 additional pads made according to Example 14 and for several control pads consisting of 14 "Never Rust" pads and 13 "SOS" pads (described above in Example 16). Additionally, 12 calcium stearate pads were prepared using the same detergent formulation as in Example 14 but in the absence of the polyacrylamide polymer. In the calcium stearate pads, a detergent and fatty acid mixture was prepared by mixing 85% of the detergent solution of Example 14 with 15% calcium stearate soap with the resulting mixture giving a pad having a detergent/soap coating that was expected to be intermediate in performance between the polymer/detergent pads of the invention and a fatty acid soap product, such as the "SOS" pad. The pads were rigorously tested to compare the solubility in water of the various soap and detergent formulations. The solubility testing was conducted at an elevated temperature (42° C.) and the data is set forth in Table 6. Several of each type of pad tested were run for each of the indicated time periods and the data is an average for the total number of pads tested. The actual number of each type of pad tested is shown in parentheses adjacent the tabulated data.

TABLE 6

| | SOAP SOLUBILITY TESTING | | | |
|---|---|---|---|---|
| PAD | % dis-solved @ 15 seconds | % dis-solved @ 30 seconds | % dis-solved @ 60 seconds | % dis-solved @ 5 minutes |
| "Never Rust" | 74.2 (5) | 89.5 (3) | 95.4 (3) | 99 (3) |
| "SOS" | 44.6 (3) | 60 (3) | 70.2 (3) | 92.1 (4) |
| Example 14 | 66.2 (3) | 66 (3) | 79.9 (3) | 95.4 (3) |
| Ca Stearate | 55.5 (3) | 75.1 (3) | 81 (3) | 94.8 (3) |

The data set forth in Table 6 indicate a desired decrease in the rate of water solubility (without regard to the foaming or detergency) of the polymer/detergent blend of the invention compared with the polymer-free "Never Rust" pads as well as the calcium stearate control pads. The test method, however, does not take into account surface area effects relevant in the comparison with the "SOS" pads. The "SOS" pads each have a very low surface area coating of soap which, in turn, slows the solubility of the soap in water. The roll coating of the other pads tested provides a high surface area coating, allowing for faster dissolution of the soap or detergent in water. Despite these differences, the rate of dissolution of the polymer/detergent blend of the invention satisfactorily approaches the dissolution rate of a fatty acid soap. Moreover, those skilled in the art will appreciate that the fatty acid soaps are typically less effective in certain applications (e.g. dishwashing) than are synthetic detergents such as those employed in the present invention. As is shown in the various examples, the invention provides a polymer/detergent formulation which is desirably less soluble in water than conventional detergent formulations and which provides better detergency and foaming than either the conventional detergents (e.g. without a polyacrylamide binder) or the fatty acid soaps.

Although the preferred embodiments of the invention have been discussed and described in detail, those skilled in the art will appreciate that changes and modifications to the described embodiments can be made without departing from the true spirit and scope of the invention, as defined in the following claims.

I claim:

1. A cleansing article comprising:

a porous pad; and a water swellable controlled detergent release composition incorporated within said pad, said composition comprising polyacrylamide having detergent blended therein, said polyacrylamide having a weight average molecular weight of at least 5 million, said polyacrylamide and said detergem blended within said composition to allow for the controlled release of said detergent when said composition is exposed to water.

2. The cleansing article as defined in claim 1 wherein said polyacrylamide and said detergent are present in said controlled detergent release composition at a weight ratio of polymer solids:detergent solids between about 1:9 and about 1:100.

3. The cleansing article as defined in claim 1 wherein said polyacrylamide and said detergent are contained within said controlled detergent release composition at a weight ratio of polymer solids:detergent solids between about 1:12 and about 1:30.

4. The cleansing article as defined in claim 1 wherein said polyacrylamide has a weight average molecular weight within a range from about 5 million to about 15 million.

5. The cleansing article as defined in claim 1 wherein said controlled release detergent composition comprises surfactant.

6. The cleansing article as defined in claim 5 wherein said surfactant is selected from the group consisting of anionic surfactants, cationic surfactants, amphoteric surfactants, nonionic surfactants and mixtures including more than one of said surfactants.

7. The cleansing article as defined in claim 6 wherein said anionic surfactants are selected from the group consisting of sodium or ammonium salts of sulfonated alkyls, sulfonic acids, sulfated alkyl ethers, sulfated fatty esters and lauryl sulfates.

8. The cleansing article as defined in claim 6 wherein said amphoteric surfactants are selected from the group consisting of cocamidopropyl betaine, coco/oleoamidopropyl betaine and combinations thereof.

9. The cleansing article as defined in claim 6 wherein said nonionic surfactants are selected from the group consisting of ethoxylated amines and amides, fatty alkanolamides and combinations thereof.

10. The cleansing article as defined in claim 6 wherein said cationic surfactants are selected from the group consisting of lauramine oxide, lauramidopropylamine oxide, stearamide oxide and combinations thereof.

11. The cleansing article as defined in claim I wherein said porous pad comprises a material selected from the group consisting of sponge, paper, fabric, plastic fibers, plastic ribbons, metal fibers, metal ribbons, and composite structures incorporating one or more of the foregoing materials.

12. The cleansing article as defined in claim 11 wherein said metal fibers are steel wool.

13. The cleansing article as defined in claim 11 wherein said porous pad is a nonwoven lofty low density abrasive scouring pad.

14. A cleansing article, comprising:

a pad comprising a lofty nonwoven, open, three-dimensional network of fibers; and a water swellable controlled detergent release composition coated on said fibers, said composition comprising a polyacrylamide having a detergent therein to provide a weight ratio of polymer solids:detergent solids between about 1:9 and about 1:100 and, said polyacrylamide having a weight average molecular weight of at least 5 million, wherein said composition provides the controlled release of said detergent when wet.

15. The cleansing article as defined in claim 14 wherein said weight ratio of polymer solids:detergent solids is between about 1:12 and about 1:30.

16. The cleansing article as defined in claim 14 wherein said detergent comprises surfactant.

17. The cleansing article as defined in claim 16 wherein said surfactant is selected from the group consisting of anionic surfactants, cationic surfactants, amphoteric surfactants, nonionic surfactants and mixtures including more than one of said surfactants.

18. The cleansing article as defined in claim 17 wherein said anionic surfactants are selected from the group consisting of sodium or ammonium salts of sulfonated alkyls, sulfonic acids, sulfated alkyl ethers, sulfated fatty esters and lauryl sulfates.

19. The cleansing article as defined in claim 17 wherein said amphoteric surfactants are selected from the group consisting of cocamidopropyl betaine, coco/oleoamidopropyl betaine and combinations thereof.

20. The cleansing article as defined in claim 17 wherein said nonionic surfactants are selected from the group consisting of ethoxylated amines and amides, fatty alkanolamides and combinations thereof.

21. The cleansing article as defined in claim 17 wherein said cationic surfactants are selected from the group consisting of lauramine oxide, lauramidopropylamine oxide, stearamide oxide and combinations thereof.

22. A process for the manufacture of a cleansing article, the process comprising:

preparing a coatable composition comprising polyacrylamide having a weight average molecular weight of at least 5 million, detergent and a liquid vehicle, said coatable composition on drying forms a controlled detergent release composition which releases said detergent in a controlled manner when wet;

applying said coatable composition to a porous pad; and drying said coatable composition to provide said controlled detergent release composition within said porous pad.

23. The process as defined in claim 22 wherein said detergent comprises surfactant selected from the group consisting or anionic surfactants, amphoteric surfactants, nonionic surfactants, cationic surfactants and mixtures of one or more of said surfactants; blending said polyacrylamide and said detergent in water to provide said coatable composition with a polymer solids:detergent solids weight ratio between about 1:12 and about 1:30.

24. The process as defined in claim 23 wherein said anionic surfactant is selected from the group consisting of sodium or ammonium salts of sulfonated alkyls, sulfonic acids, sulfated alkyl ethers, sulfated fatty esters and lauryl sulfates.

25. The process as defined in claim 23 wherein said amphoteric surfactant is selected from the group consisting of cocamidopropyl betaine, coco/oleoamidopropyl betaine and combinations thereof.

26. The process as defined in claim 23 wherein said nonionic surfactant is selected from the group consisting of ethoxylated amines and amides, fatty alkanolamides and combinations thereof.

27. The process as defined in claim 23 wherein said cationic surfactant is selected from the group consisting of lauramine oxide, lauramidopropylamine oxide, stearamide oxide and combinations thereof.

28. The process as defined in claim 23 wherein said polyacrylamide has a weight average molecular weight from about 5 million to about 15 million.

29. The process as defined in claim 22 wherein said pad comprises a material selected from the group consisting of sponge, paper, fabric, plastic fibers, plastic ribbons, metal fibers, metal ribbons, and composite structures incorporating one or more of the foregoing materials.

30. The process as defined in claim 22 wherein said applying comprises roll coating, spray coating, immersion coating or injection coating.

31. The process as defined in claim 22 wherein said drying is accomplished by heating.

32. The process as defined in claim 31 wherein said heating is accomplished in an oven at a temperature between about 93° C. and about 149° C. for between about 5 and about 45 minutes.

* * * * *